US008517327B2

(12) United States Patent
Kaiser

(10) Patent No.: US 8,517,327 B2
(45) Date of Patent: Aug. 27, 2013

(54) SUPPORT PLATE

(75) Inventor: Josef Kaiser, Regensburg (DE)

(73) Assignee: Krones AG (DE)

( * ) Notice: Subject to any disclaimer, the term of this patent is extended or adjusted under 35 U.S.C. 154(b) by 728 days.

(21) Appl. No.: 12/518,088

(22) PCT Filed: Nov. 21, 2007

(86) PCT No.: PCT/EP2007/010051

§ 371 (c)(1),
(2), (4) Date: Sep. 3, 2009

(87) PCT Pub. No.: WO2008/067907

PCT Pub. Date: Jun. 12, 2008

(65) Prior Publication Data

US 2010/0320350 A1 Dec. 23, 2010

(30) Foreign Application Priority Data

Dec. 5, 2006 (DE) ..... 20 2006 018 378 U

(51) Int. Cl.
*A47B 91/00* (2006.01)

(52) U.S. Cl.
USPC ..... 248/346.01

(58) Field of Classification Search
USPC ..... 248/346.01, 346.11; 108/22, 139, 108/102; 29/281.1
See application file for complete search history.

(56) References Cited

U.S. PATENT DOCUMENTS

| | | | | | |
|---|---|---|---|---|---|
| 2,151,205 | A | * | 3/1939 | Hawn | 408/56 |
| 2,684,172 | A | * | 7/1954 | Ruppert | 220/592.14 |
| 3,011,646 | A | * | 12/1961 | Boronkay | 210/361 |
| 3,013,309 | A | * | 12/1961 | Maier et al. | 264/564 |
| 3,860,209 | A | * | 1/1975 | Strecker | 410/116 |
| 3,889,837 | A | * | 6/1975 | Wilson | 220/7 |
| 4,143,754 | A | | 3/1979 | Eldred | 198/379 |
| 4,807,421 | A | * | 2/1989 | Araki et al. | 53/167 |
| 4,909,723 | A | * | 3/1990 | Slat et al. | 425/503 |
| 6,450,470 | B1 | * | 9/2002 | Shuen | 248/346.01 |
| D658,267 | S | * | 4/2012 | Brockington et al. | D23/206 |

FOREIGN PATENT DOCUMENTS

| | | |
|---|---|---|
| DE | 2558230 | 7/1977 |
| DE | 3638116 | 5/1988 |
| DE | 102004054891 | 5/1988 |
| EP | 0547300 | 6/1993 |
| WO | WO 95/26301 | 10/1995 |

* cited by examiner

*Primary Examiner* — Alfred J Wujciak
(74) *Attorney, Agent, or Firm* — Hayes Soloway P.C.

(57) ABSTRACT

A support plate for positioning containers having a base body includes at least one pressure element disposed on the base body in a spring-loaded manner, with the pressure element having at least one elongated pressure section extending parallel to a plate of the base body, and including a positioning body attached to the base body. The base body is releasably attached to the base body and has at least one opening through which the pressure element at least partly projects.

9 Claims, 6 Drawing Sheets

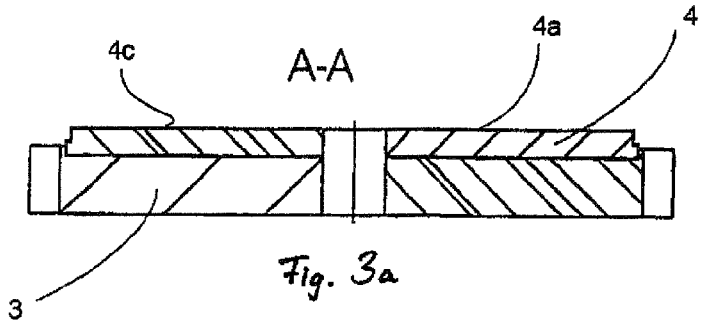
Fig. 3a
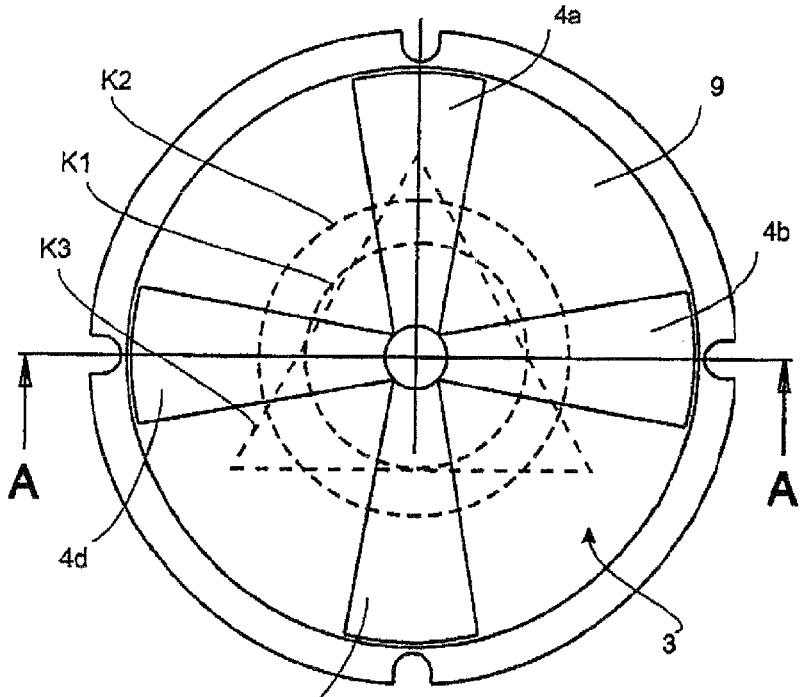
Fig. 3
Fig. 3b
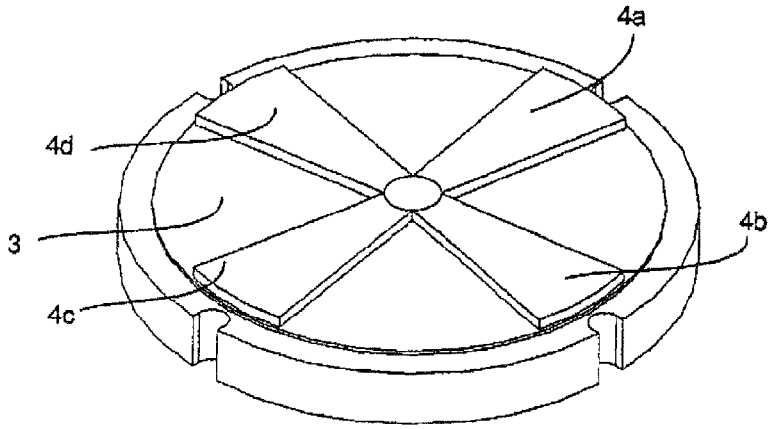
Fig. 3c

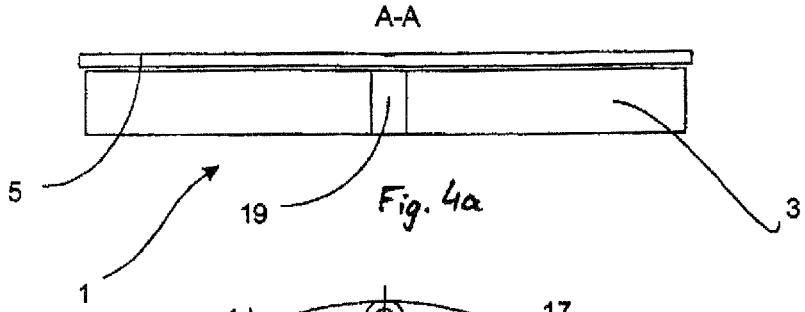
Fig. 4a
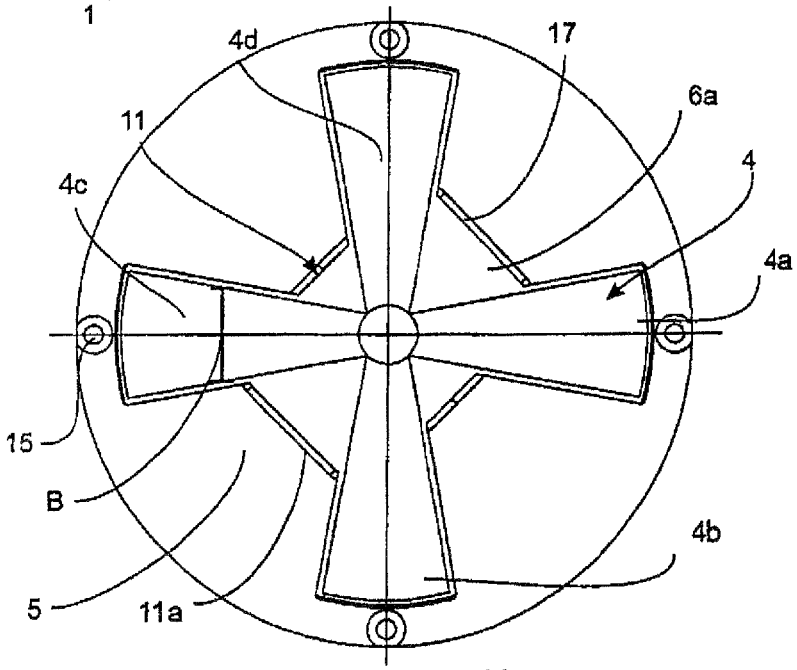
Fig. 4b
Fig. 4
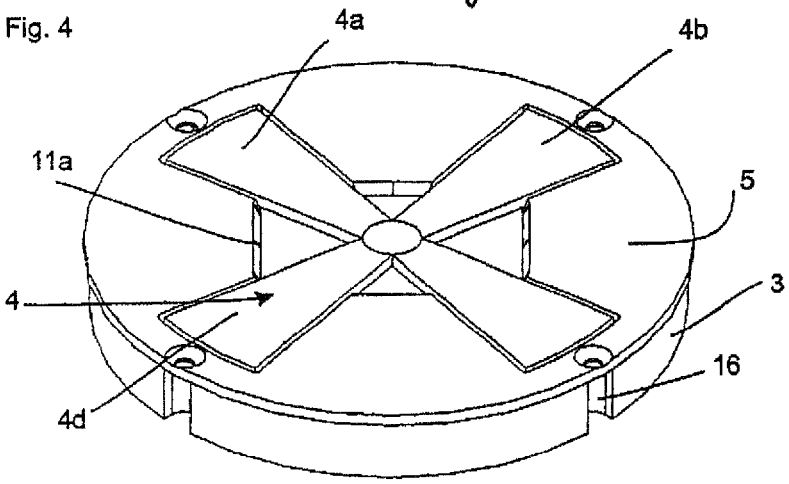
Fig. 4c

SUPPORT PLATE

BACKGROUND OF THE INVENTION

The present invention relates to a support plate for the positioning of containers. Support plates of this kind are used for example in labelling machines in order to achieve positioning and rotation of the containers in this position. These support plates may, however, also be used in other areas, in particular in the beverage industry.

Some support plates are adapted to the respective particular shape of the containers, for example to a certain diameter of bottles or also to a certain geometrical shape of the bottles. In this case, when changing over to a different bottle type, also the entire support plates will have to be replaced.

Therefore there are also devices known from the prior art, which allow an adaptation to various bottle types.

A container alignment means is known from EB 0 547 300 B1. This container alignment means includes a carrier which in turn supports a plurality of vertically moveable pins. As a container is placed on the container alignment device, those pins are lowered down which are located directly underneath the container. The remaining pins, which are arranged around the container, are used for aligning the container. This device allows the container to be centred relatively accurately, however, it is relatively complex since each of the individual pins needs to be activated each by means of spring elements. In addition, any adaptation to bottle geometries deviating from the circular shape, for example to triangular bottle shapes, is possible only with restrictions.

DE 10 2004 054 091 A1 describes a bottle plate. This bottle plate comprises a bottle plate base portion and a bottle plate top portion removably secured to the bottle plate base portion. In this connection, the removability feature is in particular useful because it makes it possible to replace worn friction coverings of the bottle plate top portion. This bottle plate top will, during operation, be pressed against the bottom of the container.

A turntable centring device for items to be labelled is provided in DE 36 35 116 A1. Herein, a stationary support plate is disposed on a pedestal via support springs. A centring pin projects through the centre of this support plate, which is used for centring a container placed on top of the support plate. This device makes it possible to centre such containers which have a recess in the container bottom. This device does not, however, allow other containers to be centred. The pressure action on the container is exercised by the support plate.

A device for non-rotatably fixing a shaped bottle is known from DE 25 58 230. On this device a table is provided which includes an indentation for positively receiving the bottom portion of the bottle, with a spring-loaded ejector drift being disposed in this indentation. A conversion of this device to various geometric bottle shapes is not provided for. Apart from that, this device does not allow containers having cross sections deviating from the circular form to be centred.

SUMMARY OF THE INVENTION

The present invention is therefore based on the object of providing a support plate for positioning containers, which may be adjusted to various container forms in a simple manner.

The support plate according to the invention for positioning containers has a base body, with a pressure element being disposed on the base body. This pressure element has at least one elongated pressure section which extends essentially parallel to a plane of the base body. Further, a positioning body is provided which is disposed on the base body.

According to the invention, the positioning body is releasably disposed on the base body and has at least one opening through which the pressure element at least partly projects. It is to be noted that by this means the pressure on the container is not only applied through the positioning body but also through the pressure element which is preferably spring-loaded.

A base body is to be understood to mean particularly a pedestal of the support plate, which may be put into a rotating movement. Whilst this makes the positioning body releasable, in the connected condition it is non-rotatably connected to this base body.

A pressure element is understood to mean an element which may apply a certain pressure on the container, in order to clamp the container for example between the support plate and a receiving means disposed at the other end of the container. Preferably, the pressure element is disposed on the base body in a spring-loaded manner, so that the container may be clamped by means of this spring force. The pressure section is in contact with the container and in particular with a section of the bottom of the container. An elongated pressure section is understood to mean that this pressure section has at least one shorter side and one longer side, with the longer side considerably exceeding the extension of the shorter side and being in particular at least twice as long, preferably at least three times as long and particularly preferably at least four times as long as the shorter side.

The plane of the base body is understood to mean that plane which extends essentially parallel to the direction of extension of the container bottom. The longitudinal direction of the container is thus perpendicular to the plane of the base body.

The elongated pressure section extends essentially parallel to this plane, but in certain conditions it may extend also in the plane of the base body.

In general, however, the pressure section is located above the plane of the base body.

Essentially parallel is understood to mean that an angle between the pressure section and the plane amounts to less than 10°, preferably less than 7° and particularly preferably less than 5°.

A releasable attachment of the positioning body on the base body is understood to mean that it is not permanently connected to the base body, but is connected to the base body for example via screw connections, magnetic connections, snap-on connections and the like and can in this way be quickly released therefrom.

By making the positioning body releasable from the base body it is achieved that the support plate may be quickly adapted to different container shapes by simply removing the positioning body from the base body and attaching another positioning body on the base body. The pressure elements and in particular also the pressure sections may project through the openings of the positioning body. In this way, pressure may be applied on the container bottoms through the positioning body, and thus the containers may be clamped (for example by means of a centring bell) In an advantageous embodiment the pressure element has a cruciform shape. This means that the pressure element has particularly preferably two elongated sections intersecting at an angle of at least 70°, preferably at least 80° and particularly preferably in the area of 90° By means of this cruciform shape, a particularly advantageous covering of the surface of the support plate may be achieved. In this way, an adaptation to very different geometries and diameters of the containers becomes possible. Thus, on the one hand small containers, on the other hand, however, also circular cross-sections of containers may be received by the cruciform shape of the pressure section. Also cross sections deviating from this circular form may be received by such a cruciform pressure section, since it is ensured that also these cross sections are supported on at least three points not lying on one line, so that the container may be held securely.

However, it would also be possible for the pressure section to have two elongated subsections which are arranged essentially parallel or at a predetermined angle to one another. Also a zigzag-shaped embodiment of the pressure section would be possible, in order to accommodate in this way both different diameters of container bottoms and different geometric cross sections.

The individual pressure sections may each have rectangular cross sections, but it is also possible that the widths of the pressure sections change outwards in a radial direction of the support plate and in particular increase in size.

In its overall shape, the pressure element may adopt for example the shape of a Greek cross, a cross pattern, a Maltese cross or the like.

In addition, the pressure element may also have a star shape or could have three rectangular sections spaced apart from one another in a circumferential direction each by an angle of 120°.

Preferably, the positioning body has centring means for centring the container. To put it more accurately, the centring means is suitable for centring the bottom of the container and thus the container itself relative to the positioning body. Particularly advantageously the centring means is a centring ring. This centring ring is intended particularly for circular container bottoms. The centring means, however, may have for example a triangular or rectangular cross section, in order to enable in this way an adaptation to containers having a triangular or rectangular cross section.

Thus, the centring means particularly preferably has a cross section selected from a group of cross sections which consist of circular cross sections, elliptic cross sections, polygonal cross sections, combinations thereof and the like.

The centring means preferably has a tapered diameter. This means that the diameter of the centring means decreases particularly in the direction of the base body. This makes an improved centring of the container possible.

Preferably, the positioning body is attached to the base body by means of screw connections. However, also different releasable connections would be possible, such as snap-on closures, magnetic connections and the like.

In a further preferred embodiment, the pressure element has a symmetrical shape. This is advantageous in order to adapt to various geometric shapes of the containers. Also, this facilitates a high-speed rotation of the support plate.

In a further advantageous embodiment, the positioning body is made from a material selected from a group of materials including Oldoflex, PUR foam, PAG, PET, thermoplastics, thermoset plastics, combinations thereof and the like.

Preferably, the opening of the positioning body is adapted to the shape of the pressure element. This means that the pressure element or the pressure section/pressure sections will enter exactly through the opening into the positioning body. Preferably, the opening in the positioning body is also cruciformly shaped. Herein, the term cruciform is understood to include also embodiments made up from circular openings and cruciform patterns projecting therefrom.

Advantageously, the positioning body has a circular shape.

The present invention is further directed to a base body for a support plate for the positioning of containers. This base body has at least one pressure element which is disposed on the base body in a spring-loaded manner and will penetrate into it due to the spring loading. In this connection, the pressure element has at least one elongated pressure section which extends parallel to a plane of the base body. According to the invention, the pressure section has a cruciform shape. This cruciform shape allows, as mentioned above, an adaptation to the most varied container geometries to be carried out. Preferably, the base body is implemented in the manner described above.

Whilst according to a further preferred embodiment the pressure element is formed in a spring-loaded manner relative to the base body, however, the pressure element will, when spring-loaded, not be introduced into the base body, but will be displaced in relation to a distance between the base body and the positioning body.

The present invention further relates to a positioning body for a support plate for the positioning of containers. This positioning body includes a fastening means which can be used to releasably dispose the positioning body on a base body of the support plate. Further, the positioning body has at least one opening through which a pressure element of the base body may enter.

According to the invention, the opening has a cruciform shape at least in certain sections. Such a section-wise cruciform shape is understood to mean in particular also such geometries which have a cruciform shape for example only in the external areas.

By means of this positioning body, too, the object of ensuring an adaptation to various container geometries is achieved.

A fastening means is understood to mean any means used for fastening the positioning body to the base body. This may be for example a screw connection, but the fastening means may also be a bore through which a screw/bolt may be guided in order to fasten the positioning body to the base body.

Preferably, the positioning body is implemented in the manner described above.

BRIEF DESCRIPTION OF THE DRAWINGS

Further advantages and embodiments will become obvious from the attached drawings, wherein:

FIGS. 3*a*-3*c* show a base body for a support plate according to the invention;

FIGS. 4*a*-4*c* show a further embodiment of a support plate according to the invention.

DETAILED DESCRIPTION

FIGS. 1-4 each show three perspectives of the individual support plates, the positioning body or the base body. Each of the top illustrations shows a lateral view of the base body or a cross section along specified lines (A-A). The centre picture shows, in each case, a top view of the respective support plate, the respective positioning body or the respective base body. The bottom illustration in the figures shows, in each case, a perspective view of the respective device.

Figure 1A:
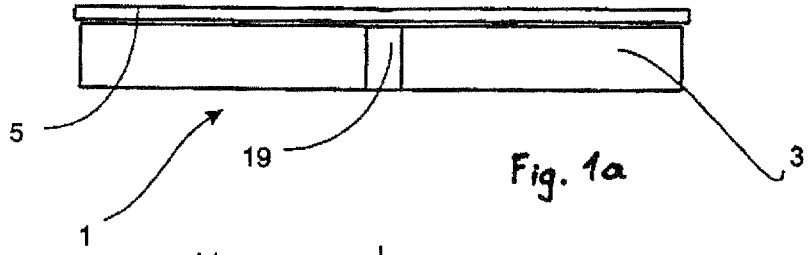
FIGS. 1*a*-1*c* show a support plate according to the invention.
Figure 1B:
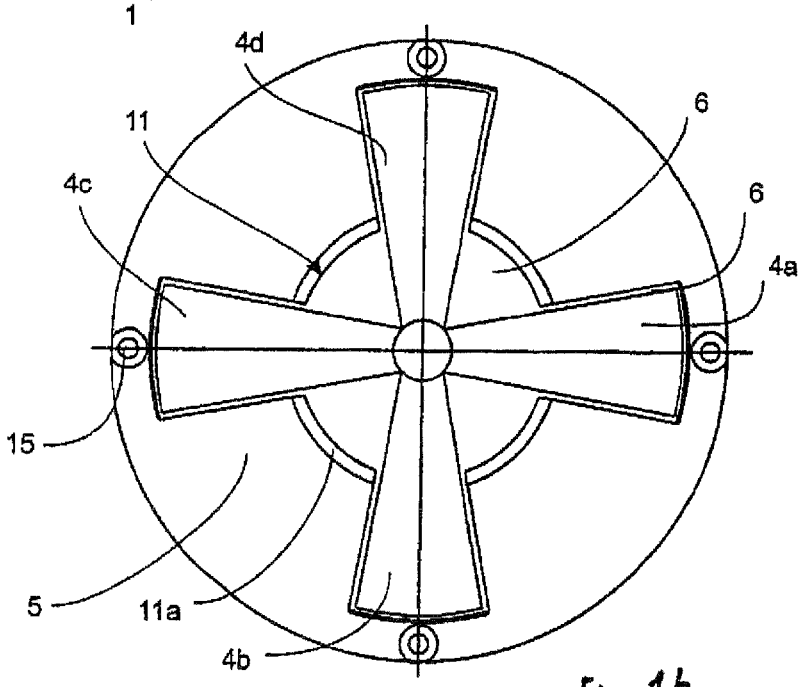
Figure 1C:
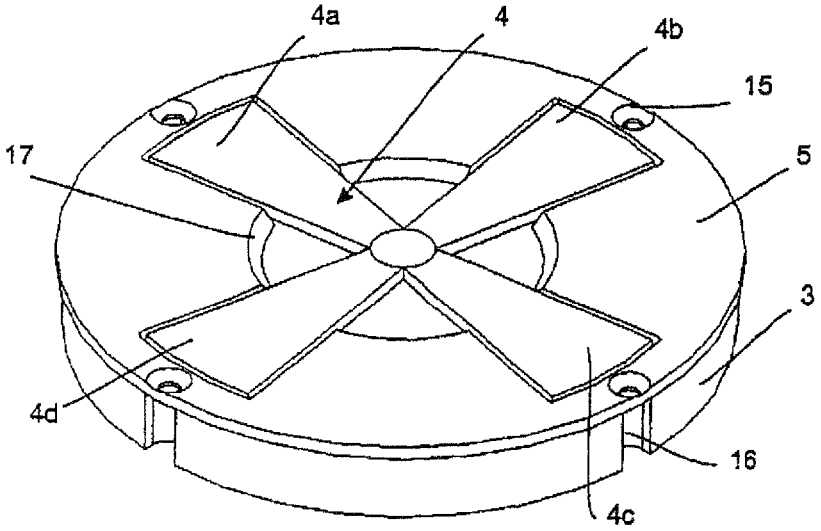

FIGS. 1*a*-1*c* show a support plate 1 according to the invention. This includes a base body 3 on which a positioning body 5 is disposed. In this connection, this positioning body 5 cannot be disposed via screw connections (not shown) to the base body 3. For this purpose, the positioning body 5 has four fastening means 15 in the form of bores through which screws/bolts are guided and may be screwed into threads 16 of the base body 3. A pressure element 4 is disposed on the base body 3. This pressure element 4 has four pressure sections 4*a*, 4*b*, 4*c*, 4*d*. These pressure sections 4*a*, 4*b*, 4*c*, 4*d* are each elongated, or put more accurately, an elongated section is made up from the sections 4*a* and 4*c* and also from the sections 4*b* and 4*d*. Overall, the pressure sections 4*a*, 4*b*, 4*c* and 4*d* occupy a cruciform area. In this way, the most varied container geometries may be placed and stabilised on the support plate 1 or the pressure element 4. The reference numeral 19 indicates a bore for the rotational positioning of the support plate 1.

In the embodiment shown in FIGS. 1-4, the widths B of the pressure sections 4*a*, 4*b*, 4*c* and 4*d* increase in a radial direction of the support plate 1 from the inside outwards. However, also other shapes may be conceivable, such as curved shapes or rectangular shapes having a constant width.

Figure 2A:
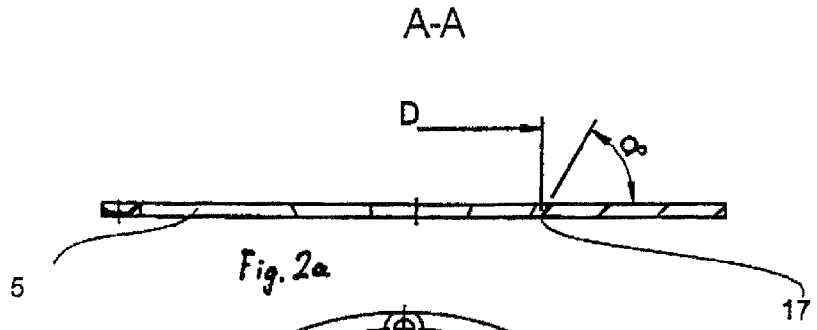
FIGS. 2*a*-2*c* show a positioning body for a support plate according to the invention.
Figure 2B:
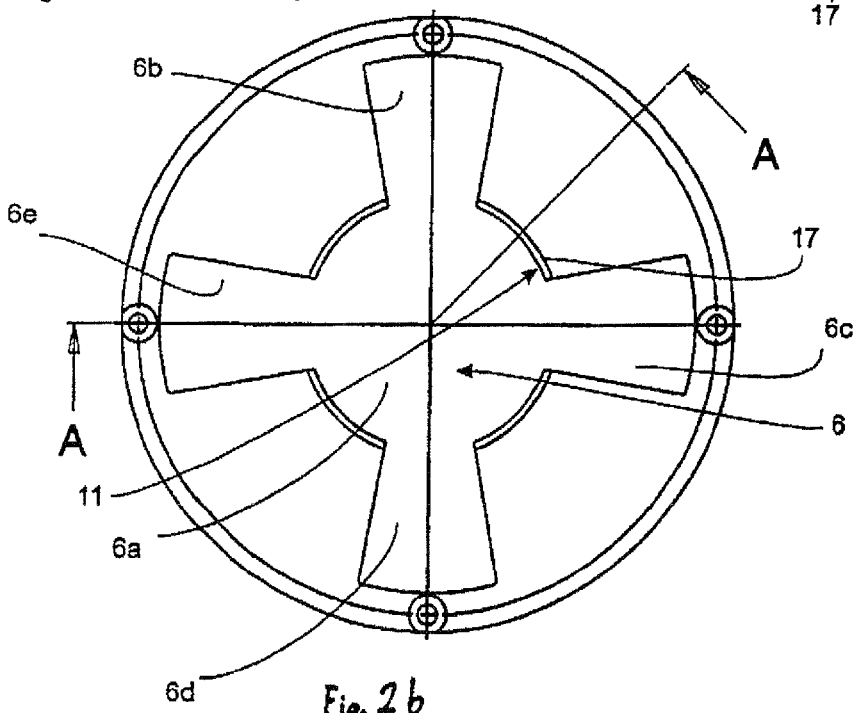
Figure 2C:
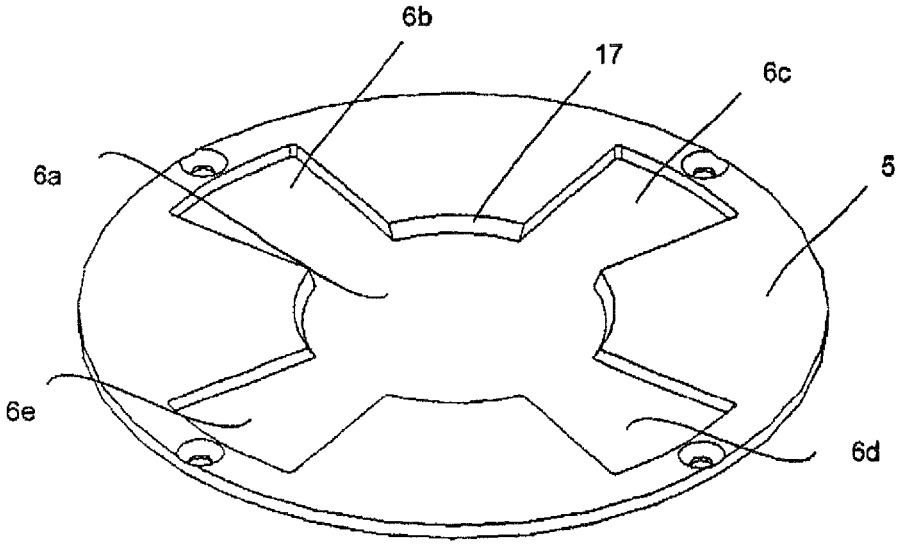

FIGS. 2*a*-2*c* show a positioning body 5 for the support plate 1 of FIGS. 1*a*-1*c*. It can be seen that this positioning body 5 has an opening 6. This opening 6 has a circular central section 6*a* and four elongated sections 6*b*, 6*c*, 6*d* and 6*e*. As shown in FIGS. 1*b* and 1*c*, the pressure element 4 projects through these sections. The central opening section 6*a* is used for centring the container and constitutes in this embodiment a centring ring. This centring ring 11 has bevelled surfaces 17 or tapered sections 17, which allow a container to be centred relative to the positioning body 5. The bevelled surface 17 is inclined at an angle u relative to the plane of the positioning body 5.

Thus, an adaptation to various container shapes may be achieved, in which the same base body 3 may be used in each case and only the positioning body 5, which may for instance be a foam shape, may be replaced. This means, the base body 3 is a serial part whilst the positioning body 5 is a format part.

FIGS. 3*a*-3*c* show a base body 3 for the support plate 1 according to the invention. As explained above, the pressure element 4 has a cruciform cross section. The pressure element 4 is spring-loaded relative to the base body 3 or the support surface 9 thereof. However, also an elastic implementation of the pressure element would be possible. The circular lines K1 and K2 illustrate various container diameters. In both cases, a corresponding container may be supported by the pressure element 4. Also for example a container having a triangular cross section, as indicated by means of line K3, may be supported efficiently by the pressure element 4 on at least 3 points, independent from the rotational position of this triangular container in relation to the base body 3. In this case, the positioning body 5 or the opening 6 thereof would be correspondingly adapted to a triangular container.

FIGS. 4*a*-4*c* show a further embodiment of a support plate 1 according to the invention. Contrary to the embodiments shown in FIGS. 1-3, the positioning body 5 here has a rectangular central section Ga. In this embodiment, the positioning body 5 is thus adapted for receiving containers having a rectangular cross section.

Figure 5:
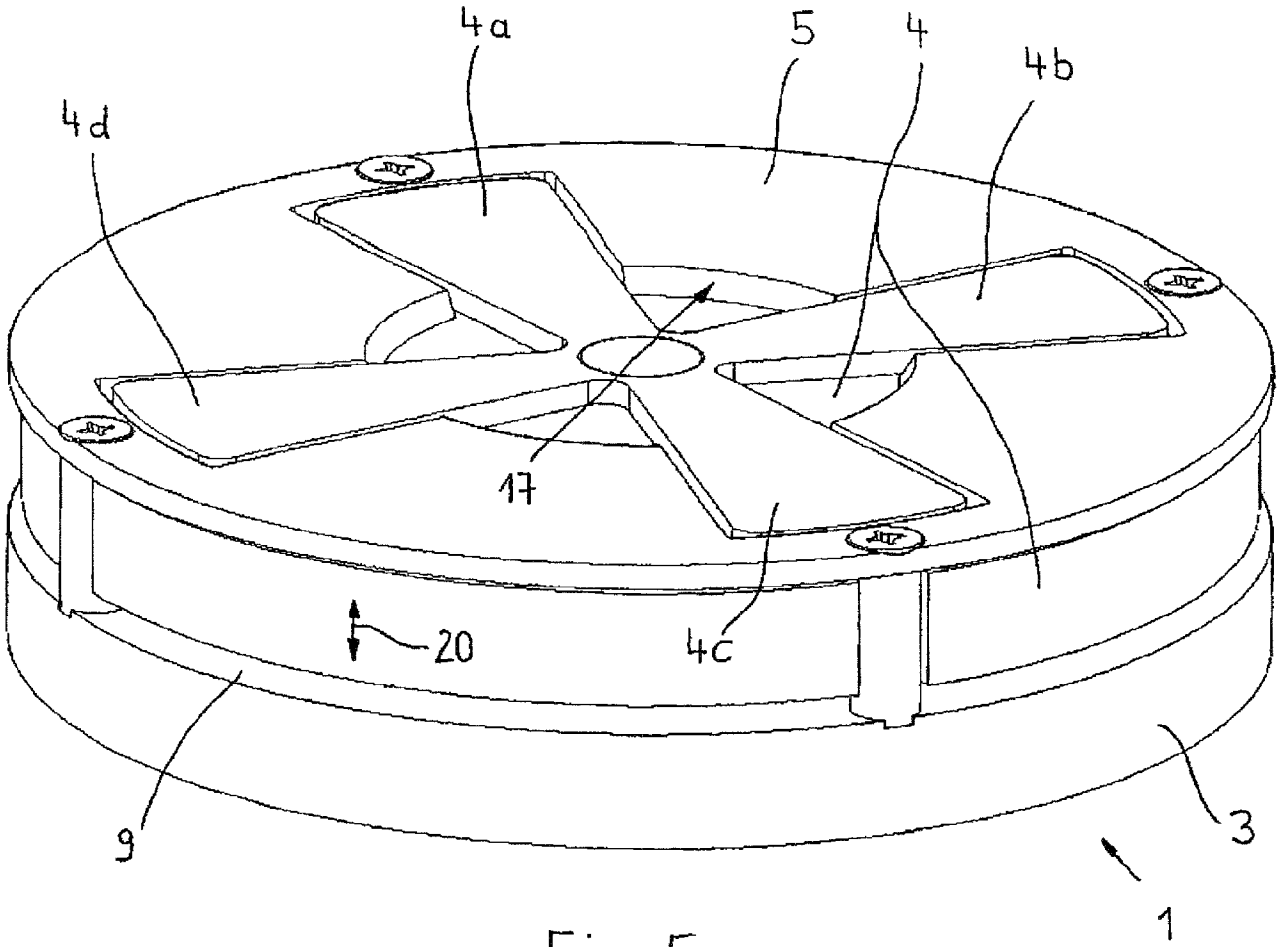
FIGS. 5 and 5*a* show another embodiment of a support plate according to the invention.
Figure 5A:
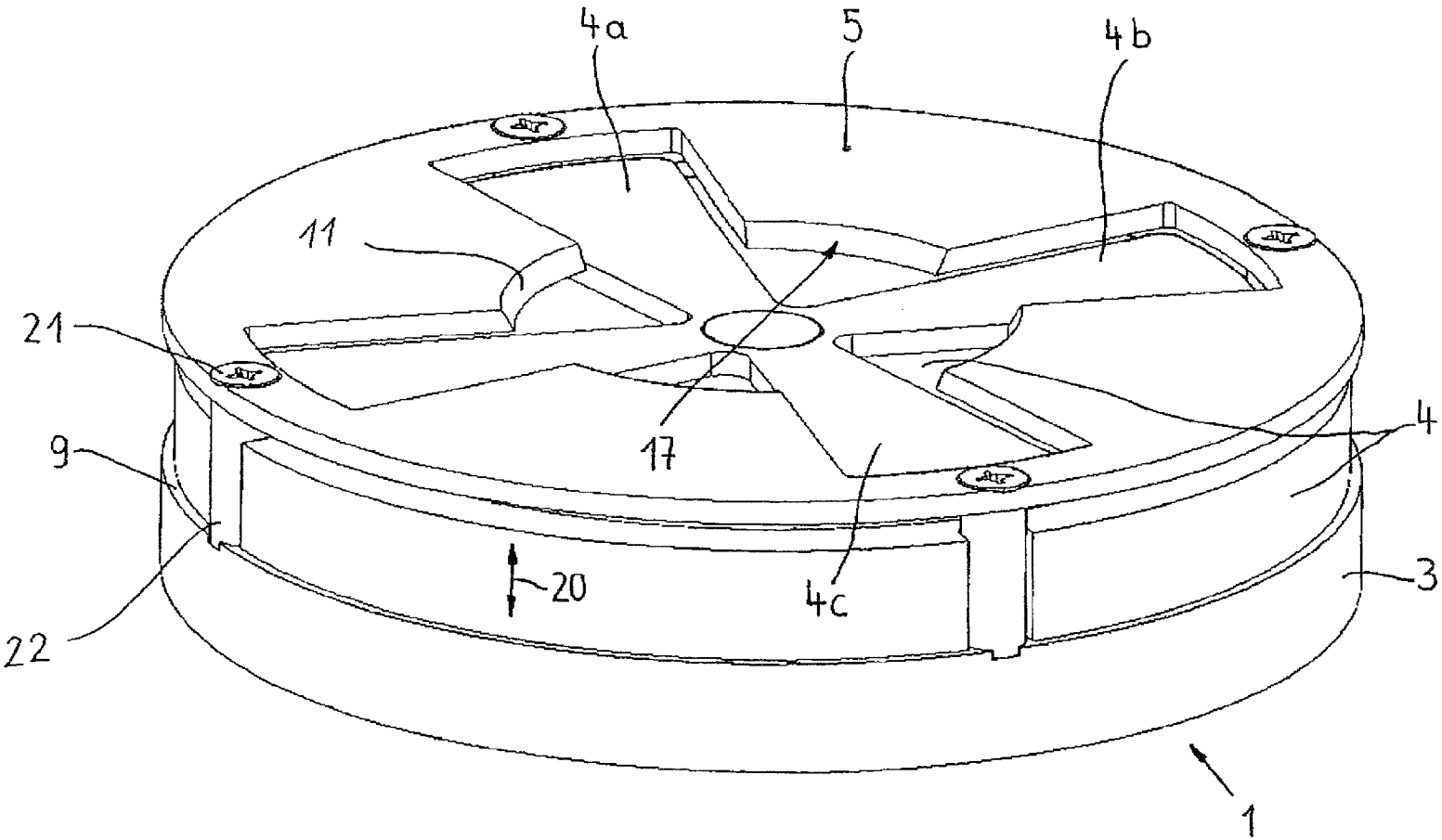

FIGS. 5 and 5*a* show another embodiment of the support plate 1, wherein the pressure sections 4*a*, 4*b*, 4*c* and 4*d* are not spring-loaded into the base body as shown in FIGS. 1-4, but wherein the pressure element 4 is made up from a disk according to the base body 3 with pressure sections 4*a*, 4*b*, 4*c* and 4*d* rigidly attached thereto. When the pressure element 4 is spring-loaded relative to the base body 3, the entire pressure element 4 will be moved in the direction of the arrow 20. On the support surface 9 of the base body 3, there is a spring which is not shown herein, which effects the return movement of the pressure element 4 into the home position as shown in FIG. 5. FIG. 5*a* shows the support plate 1 from FIG. 5, with the pressure element 4 being deflected, so that the centring ring 11 forms a support surface for containers. In this embodiment, the positioning body 5 is fixed to the base body 3 by means of screw connections 21 and spacers 22, so that the pressure element 4 with the pressure sections 4*a*, 4*b*, 4*c*, 4*d* rigidly attached thereto may freely move upwards and downwards along the arrow 20.

All of the features disclosed in the application materials are claimed as essential to the invention, in as far as they are novel either individually or in combination compared to the prior art.

The invention claimed is:

1. A support plate for the positioning of containers for high-speed rotation of the containers, the support plate, including a base body, at least one pressure element disposed on the base body, with the pressure element having at least one elongated pressure section and a cruciform shape which extends essentially parallel to a plane of the base body and applies pressure on the container to be positioned, and a positioning body disposed on the base body, wherein the positioning body is releasably attached to the base body by screw connections and has at least one opening through which the pressure element at least partly projects.

2. The support plate as claimed in claim 1, wherein the pressure element has several pressure sections.

3. The support plate as claimed in claim 2, wherein the pressure element has four elongated pressure sections.

4. The support plate as claimed in claim 1, wherein the positioning body has a centring device for centring the container.

5. The support plate as claimed in claim 4, wherein the centring device is a centring ring.

6. The support plate as claimed in claim 1, wherein the pressure section has a symmetrical shape.

7. The support plate as claimed in claim 1, wherein the positioning body is made from a material selected from a group of materials consisting of Oldoflex, PUR foam, PAG, PET, a thermoplastic, a thermoset plastic, and a combination thereof.

8. The support plate as claimed in claim 1, wherein the opening is adapted to the shape of the pressure element.

9. A labelling machine for labelling containers with various geometric shapes, including the support plate and base body as claimed in claim 1.

* * * * *